US005378681A

United States Patent [19]

Schallner et al.

[11] Patent Number: 5,378,681

[45] Date of Patent: Jan. 3, 1995

[54] SUBSTITUTED TRIAZOLINONES

[75] Inventors: Otto Schallner, Monheim; Wilhelm Haas, Pulheim; Karl-Heinz Linker; Kurt Findeisen, both of Leverkusen; Klaus König, Odenthal; Albrecht Marhold; Hans-Joachim Santel, both of Leverkusen; Robert R. Schmidt, Bergisch Gladbach, all of Germany

[73] Assignee: Bayer Aktiengesellschaft, Leverkusen, Germany

[21] Appl. No.: 153,935

[22] Filed: Nov. 16, 1993

[30] Foreign Application Priority Data

Nov. 23, 1992 [DE] Germany ..... 4239269

[51] Int. Cl.[6] ..... A01N 43/653; C07D 249/12

[52] U.S. Cl. ..... 504/273; 548/263.4; 548/264.2

[58] Field of Search ..... 504/273; 548/263.4, 548/264.2

[56] References Cited

U.S. PATENT DOCUMENTS

| | | | |
|---|---|---|---|
| 4,069,035 | 1/1978 | Johnson | 504/180 |
| 4,818,275 | 4/1989 | Theodoridis | 504/273 |
| 5,006,148 | 4/1991 | Fisher et al. | 504/280 |
| 5,041,155 | 8/1991 | Theodoridis | 504/273 |

FOREIGN PATENT DOCUMENTS 0370332 11/1989 European Pat. Off. .

OTHER PUBLICATIONS

CA, vol. 108, 1988, p. 673.
CA, vol. 72, 1970, p. 372.

*Primary Examiner*—Glennon H. Hollrah
*Assistant Examiner*—Mary C. Cebulak
*Attorney, Agent, or Firm*—Sprung Horn Kramer & Woods

[57] ABSTRACT

The invention relates to new substituted triazolinones of the general formula (I)

(I)

in which $R^1$ represents hydrogen, alkyl, alkoxy, halogenoalkyl or halogenoalkoxy, $R^2$ represents hydrogen, alkyl or halogenoalkyl, $R^3$ represents hydrogen or halogen, $R^4$ represents hydrogen, cyano, halogen or a radical of the formula —O—$R^6$, —S—$R^6$, —C(O)—O—$R^6$, —C(O)—S—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or in each case optionally substituted alkyl, alkenyl, alkinyl, cycloalkyl, cycloalkylalkyl, cycloalkoxycarbonyl, aryl or arylalkyl, to a plurality of processes for their preparation, and to their use as herbicides.

13 Claims, No Drawings

SUBSTITUTED TRIAZOLINONES

The invention relates to new substituted triazolinones, to a plurality of processes for their preparation, and to their use as herbicides.

It has been disclosed that certain substituted triazolinones such as, for example, the compound 3-methyl-4-propargyl-1-(2,5-difluoro-4-cyanophenyl)-1,2,4-triazolin-5-one have herbicidal properties (cf., for example, DE 3,839,480).

However, the herbicidal activity of these previously known compounds against problem weeds and also their compatibility with important crop plants are not entirely satisfactory in all fields of application.

New substituted triazolinones of the general formula (I)

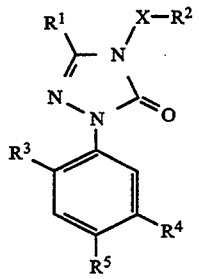

(I)

which $R^1$ represents hydrogen, alkyl, alkoxy, halogenoalkyl or halogenoalkoxy, $R^2$ represents hydrogen, alkyl or halogenoalkyl, $R^3$ represents hydrogen or halogen, $R^4$ represents hydrogen, cyano, halogen or a radical of the formula —O—$R^6$, —S—$R^6$, —C(O)—O—$R^6$, —C(O)—S—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or in each case optionally substituted alkyl, alkenyl, alkinyl, cycloalkyl, cycloalkylalkyl, cycloalkoxycarbonyl, aryl or arylalkyl, have now been found.

If appropriate, the compounds of the formula (I) can exist in the form of geometric and/or optical isomers or isomer mixtures of various compositions, depending on the nature of the substituents. The invention claims the pure isomers as well as the isomer mixtures.

Furthermore, it has been found that the new substituted triazolinones of the general formula (I)

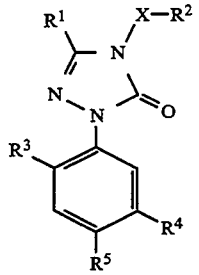

(I)

in which $R^1$ represents hydrogen, alkyl, alkoxy, halogenoalkyl or halogenoalkoxy, $R^2$ represents hydrogen, alkyl or halogenoalkyl, $R^3$ represents hydrogen or halogen, $R^4$ represents hydrogen, cyano, halogen or a radical of the formula —O—$R^6$, —S—$R^6$, —C(O)—O—$R^6$, —C(O)—S—$R^6$, —$NR^6$, $R^7$ or —C(O)—$NR^6R^7$, $R^5$ represents cyano or nitro and X represents oxygen or sulphur, where $R^6$ and $R^7$ independently of one another in each case represent hydrogen or in each case optionally substituted alkyl, alkenyl, alkinyl, cycloalkyl, cycloalkylalkyl, cycloalkoxycarbonyl, aryl or arylalkyl, are obtained when 1H-triazolinones of the formula (II)

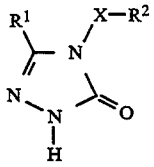

(II)

in which $R^1$, $R^2$ and X have the abovementioned meanings, are reacted with halogenobenzene derivatives of the formula (III)

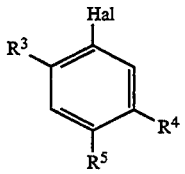

(III)

in which $R^3$, $R^4$ and $R^5$ have the abovementioned meanings and Hal represents halogen, if appropriate in the presence of a diluent and if appropriate in the presence of a reaction auxiliary, or when b) substituted triazolinones of the formula (Ia),

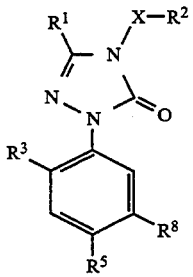

(Ia)

in which $R^1$, $R^2$, $R^3$, $R^4$ and X have the abovementioned meanings and $R^8$ represents halogen, are reacted with nucleophiles of the formula (IV)

$$R^9—Z—H \quad (IV)$$

in which

Z represents oxygen, sulphur or the radical —N($R^7$)—, $R^9$ represents in each case optionally substituted alkyl, alkenyl, alkinyl, cycloalkyl or aryl and $R^7$ has the abovementioned meaning, if appropriate in the presence of a diluent and if appropriate in the presence of a reaction auxiliary, or when c) substituted triazolinones of the formula (V)

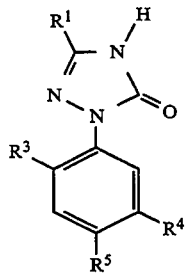

(V)

in which $R^1$, $R^3$, $R^4$ and $R^5$ have the abovementioned meanings, are reacted with sulphenylating agents of the formula (VI)

$$R^2—S—Hal \quad (VI)$$

in which $R^2$ has the abovementioned meaning and

Hal represents halogen, if appropriate in the presence of a diluent and if appropriate in the presence of a reaction auxiliary.

Finally, it has been found that the new substituted triazolinones of the general formula (I) have herbicidal properties.

Surprisingly, the substituted triazolinones of the general formula (I) according to the invention display a considerably better herbicidal activity against problem weeds combined with a comparably good useful plant selectivity compared with the substituted triazolinones which are known from the prior art such as, for example, the compound 3-methyl-4-propargyl-l-(2,5-difluoro-4-cyanophenyl)-1,2,4-triazolin-5-one, which are similar compounds chemically and from the point of view of their action.

Formula (I) provides a general definition of the substituted triazolinones according to the invention. Preferred compounds of the formula (I) are those in which $R^1$ represents hydrogen or in each case straight-chain or branched alkyl, alkoxy, halogenoalkyl or halogenoalkoxy, each of which has 1 to 8 carbon atoms and, if appropriate, 1 to 17 identical or different halogen atoms, in particular fluorine, chlorine, bromine or iodine, $R^2$ represents hydrogen or in each case straight-chain or branched alkyl or halogenoalkyl, each of which has 1 to 8 carbon atoms and, if appropriate, 1 to 17 identical or different halogen atoms, in particular fluorine, chlorine, bromine or iodine, $R^3$ represents hydrogen, fluorine, chlorine, bromine or iodine, $R^4$ represents hydrogen, cyano, fluorine, chlorine, bromine, iodine or a radical of the formula $—O—R^6$, $—S—R^6$, $—C(O)—O—R^6$, $—C(O)—S—R^6$, $—NR^6R^7$ or $—C(O)—NR^6R^7$, $R^5$ represents cyano or nitro and X represents oxygen or sulphur, where $R^6$ and $R^7$ independently of one another in each case represent hydrogen or straight-chain or branched alkyl which has 1 to 8 carbon atoms and which is optionally monosubstituted or polysubstituted by identical or different substituents, suitable substituents being:

halogen, in particular fluorine, chlorine, bromine and/or iodine, cyano, carboxyl, carbamoyl, in each case straight-chain or branched alkoxy, alkoxyalkoxy, halogenoalkoxy (where halogen represents fluorine, chlorine, bromine and/or iodine), alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkylsulphonylaminocarbonyl, each of which has up to 8 carbon atoms in the individual alkyl or alkenyl or alkinyl moieties, or heterocyclyl, the heterocyclyl radical being represented by a five- to seven-membered, optionally benzo-fused, saturated or unsaturated heterocycle having 1 to 3 identical or different hetero atoms, in particular nitrogen, oxygen and/or sulphur;

$R^6$ and $R^7$ furthermore represent alkenyl or alkinyl, each of which has 2 to 8 carbon atoms and each of which is optionally monosubstituted or polysubstituted by identical or different substituents from the series comprising fluorine, chlorine, bromine and/or iodine;

$R^6$ and $R^7$ furthermore represent cycloalkyl, cycloalkylalkyl or cycloalkyloxycarbonyl, each of which has 3 to 8 carbon atoms in the cycloalkyl moiety and, if appropriate, 1 to 4 carbon atoms in the straight-chain or branched alkyl moiety, and each of which is optionally monosubstituted or polysubstituted in the cycloalkyl moiety by identical or different substituents from the series comprising fluorine, chlorine, bromine and/or iodine and/or in each case straight-chain or branched alkyl and/or alkoxy and/or alkoxycarbonyl, each of which has 1 to 4 carbon atoms, or $R^6$ and $R^7$ represent arylalkyl or aryl, each of which has 6 to 10 carbon atoms in the aryl moiety and, if appropriate, 1 to 4 carbon atoms in the straight-chain or branched alkyl moiety and each of which is optionally monosubstituted or polysubstituted in the aryl moiety by identical or different substituents, suitable aryl substituents in each case being:

halogen, cyano, nitro, hydroxy, in each case straight-chain or branched alkyl, alkoxy, alkylthio, alkylsulphinyl or alkylsulphonyl, each of which has 1 to 6 carbon atoms, in each case straight-chain or branched halogenoalkyl, halogenoalkoxy, halogenoalkylthio, halogenoalkylsulphinyl or halogenoalkylsulphonyl, each of which has 1 to 6 carbon atoms and 1 to 13 identical or different halogen atoms, straight-chain or branched alkoxycarbonylalkyloxy having 1 to 6 carbon atoms in the individual alkyl moieties, and phenyl which is optionally monosubstituted or polysubstituted by identical or different substituents from the series comprising halogen and/or straight-chain or branched alkyl or alkoxy, each of which has 1 to 6 carbon atoms, and/or straight-chain or branched halogenoalkyl or halogenoalkoxy, each of which has 1 to 6 carbon atoms and 1 to 13 identical or different halogen atoms, halogen in each case denoting fluorine, chlorine, bromine and/or iodine.

Particularly preferred compounds of the formula (I) are those in which $R^1$ represents hydrogen or in each case straight-chain or branched alkyl, alkoxy, halogenoalkyl or halogenoalkoxy, each of which has 1 to 6 carbon atoms and, if appropriate, 1 to 13 identical or different halogen atoms, in particular fluorine, chlorine or bromine, $R^2$ represents hydrogen or in each case straight-chain or branched alkyl or halogenoalkyl, each of which has 1 to 6 carbon atoms and, if appropriate, 1 to 13 identical or different halogen atoms, in particular fluorine, chlorine or bromine, $R^3$ represents hydrogen, fluorine, chlorine or bromine, $R^4$represents hydrogen, cyano, fluorine, chlorine, bromine or a radical of the formula —O—$R^6$, —S—$R^6$, —C(O)—O—$R^6$, —C(O)—S—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or straight-chain or branched alkyl which has 1 to 6 carbon atoms and which is optionally monosubstituted to disubstituted by identical or different substituents, suitable substituents being:

cyano, carboxyl, carbamoyl, in each case straight-chain or branched alkoxy, alkoxyalkoxy, halogenoalkoxy (where halogen represents fluorine, chlorine and/or bromine), alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkyl sulphonylaminocarbonyl, each of which has up to 6 carbon atoms in the individual alkyl or alkenyl or alkinyl moieties, or heterocyclyl, where the heterocyclyl radical is represented by a 5- or 6-membered, saturated or unsaturated heterocycle which has 1 to 3 identical or different hetero atoms, in particular nitrogen, oxygen and/or sulphur;

$R^6$ and $R^7$ furthermore represent straight-chain or branched halogenoalkyl having 1 to 6 carbon atoms and 1 to 13 identical or different halogen atoms, in particular fluorine, chlorine and/or bromine;

$R^6$ and $R^7$ furthermore represent alkenyl or alkinyl, each of which has 2 to 6 carbon atoms and each of which is optionally monosubstituted to pentasubstituted by identical or different substituents from the series comprising fluorine, chlorine and/or bromine;

$R^6$ and $R^7$ furthermore represent cycloalkyl, cycloalkylalkyl or cycloalkyloxycarbonyl, each of which has 3 to 7 carbon atoms in the cycloalkyl moiety and, if appropriate, 1 to 3 carbon atoms in the straight-chain or branched alkyl moiety, and each of which is optionally monosubstituted to tetra-substituted in the cycloalkyl moiety by identical or different substituents from the series comprising fluorine, chlorine and/or bromine and/or in each case straight-chain or branched alkyl and/or alkoxy and/or alkoxycarbonyl, each of which has 1 to 3 carbon atoms, or $R^6$ and $R^7$ represent arylalkyl or aryl, each of which has 6 or 10 carbon atoms in the aryl moiety and, if appropriate, 1 to 3 carbon atoms in the straight-chain or branched alkyl moiety, and each of which is optionally monosubstituted to pentasubstituted in the aryl moiety by identical or different substituents, suitable aryl substituents in each case being:

halogen, cyano, nitro, hydroxy, in each case straight-chain or branched alkyl, alkoxy, alkylthio, alkylsulphinyl or alkylsulphonyl, each of which has 1 to 4 carbon atoms, in each case straight-chain or branched halogenoalkyl, halogenoalkoxy, halogenoalkylthio, halogenoalkylsulphinyl or halogenoalkylsulphonyl, each of which has 1 to 4 carbon atoms and 1 to 9 identical or different halogen atoms, straight-chain or branched alkoxycarbonylalkyloxy having 1 to 4 carbon atoms in the individual alkyl moieties, and phenyl which is optionally monosubstituted to pentasubstituted by identical or different substituents from the series comprising halogen and/or straight-chain or branched alkyl or alkoxy, each of which has 1 to 4 carbon atoms, and/or straight-chain or branched halogenoalkyl or halogenoalkoxy, each of which has 1 to 4 carbon atoms and 1 to 9 identical or different halogen atoms, halogen in each case denoting fluorine, chlorine and/or bromine.

Very particularly preferred compounds of the formula (I) are those in which $R^1$ represents hydrogen or in each case straight-chain or branched alkyl, alkoxy, halogenoalkyl or halogenoalkoxy, each of which has 1 to 4 carbon atoms and, if appropriate, 1 to 9 identical or different halogen atoms, in particular fluorine, chlorine or bromine, $R^2$ represents hydrogen or in each case straight-chain or branched alkyl or halogenoalkyl, each of which has 1 to 4 carbon atoms and, if appropriate, 1 to 9 identical or different halogen atoms, in particular fluorine, chlorine or bromine, $R^3$represents hydrogen, fluorine, chlorine or bromine, $R^4$represents hydrogen, cyano, fluorine, chlorine, bromine or a radical of the formula —O—$R^6$, —S—$R^6$, —C(O)—O—$R^6$, —C(O)—S—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or straight-chain or branched alkyl which has 1 to 4 carbon atoms and which is optionally monosubstituted, suitable substituents being:

cyano, carboxyl, carbamoyl, in each case straight-chain or branched alkoxy, alkoxyalkoxy, halogenoalkoxy (where halogen represents fluorine, chlorine and/or bromine ), alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkylsulphonylaminocarbonyl, each of which has up to 4 carbon atoms in the individual alkyl or alkenyl or alkinyl moieties, or heterocyclyl, where the heterocyclyl radical is represented by a 5- or 6-membered, saturated or unsaturated heterocycle which has 1 to 3 identical or different hetero atoms, in particular nitrogen, oxygen and/or sulphur;

$R^6$ and $R^7$ furthermore represent straight-chain or branched halogenoalkyl having 1 to 4 carbon atoms and 1 to 9 identical or different halogen atoms, in particular fluorine, chlorine and/or bromine;

$R^6$ and $R^7$ furthermore represent alkenyl or alkinyl, each of which has 3 to 5 carbon atoms and each of which is optionally monosubstituted to trisubstituted by identical or different halogen substituents, in particular fluorine, chlorine and/or bromine;

$R^6$ and $R^7$ furthermore represent cycloalkyl, cycloalkylalkyl or cycloalkyloxycarbonyl, each of which has 3 to 6 carbon atoms in the cycloalkyl moiety and, if appropriate, 1 or 2 carbon atoms in the alkyl moiety, and each of which is optionally mono-substituted or disubstituted in the cycloalkyl moiety by identical or different substituents from the series comprising fluorine, chlorine, bromine, methyl, ethyl, methoxy, ethoxy, methoxycarbonyl and/or ethoxycarbonyl, or $R^6$ and $R^7$ represent phenylalkyl or phenyl, each of which is optionally monosubstituted to trisubstituted in the phenyl moiety by identical or different substituents and has, where appropriate, 1 or 2 carbon atoms in the alkyl moiety, suitable phenyl substituents in each case being:

halogen, cyano, nitro, hydroxy, in each case straight-chain or branched alkyl, alkoxy, alkylthio, alkylsulphinyl or alkylsulphonyl, each of which has 1 to 3 carbon atoms, or in each case straight-chain or branched halogenoalkyl, halogenoalkoxy, halogenoalkylthio, halogenoalkylsulphinyl or halogenoalkylsulphonyl, each of which has 1 to 3 carbon atoms and 1 to 7 identical or different halogen atoms, and straight-chain or branched alkoxycarbonylalkyloxy having 1 to 2 carbon atoms in the individual alkyl moieties, halogen in each case denoting fluorine, chlorine and/or bromine.

The following substituted triazolinones of the general formula (I) may be mentioned individually in addition to the compounds listed in the Preparation Examples:

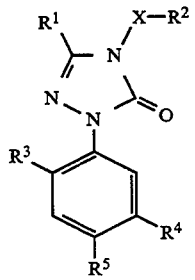

(I)

$R^5$ = CN and $NO_2$

| R1 | R2 | R3 | R4 | X |
|---|---|---|---|---|
| $CH_3$ | H | F | $-O-CH_2-C\equiv CH$ | O |
| $CH_3$ | H | F | $-O-C_2H_5$ | O |
| $CH_3$ | H | F | $-O-CH_3$ | O |
| $CH_3$ | H | F | $-S-CH_3$ | O |
| $CH_3$ | H | F | $-O-CH_2-CF_3$ | O |
| $CH_3$ | H | F | $-O-CH(CH_2F)_2$ | O |
| $CH_3$ | H | F | $-O-(CH_2-CH_2-O)_2-CH_3$ | O |
| $CH_3$ | H | F | $-O-CH_2-CH_2-O-C_2H_5$ | O |
| $CH_3$ | H | F | $-O-CH(CH_3)-COOC_2H_5$ | O |
| $CH_3$ | H | F | $-O-CH_2-COO\text{-}n\text{-}C_4H_9$ | O |
| $CH_3$ | H | F | $-O-CH_2-CH=CH_2$ | O |
| $CH_3$ | H | F | $-O-CH(CH_3)-C\equiv CH$ | O |
| $CH_3$ | H | F | $-S-CH_2-COOCH_3$ | O |
| $CH_3$ | H | F | $-S-CH_2-C\equiv CH$ | O |
| $CH_3$ | H | F | $-S-C_2H_5$ | O |
| $CH_3$ | H | F | $-O\text{-}i\text{-}C_3H_7$ | O |
| $CH_3$ | H | F | $-CH_2-CN$ | O |
| $CH_3$ | H | F | $-O-CH(CH_3)-COO-CH_2-C\equiv CH$ | O |
| $CH_3$ | H | F | 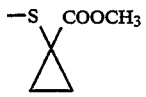 | O |
| $CH_3$ | H | F | 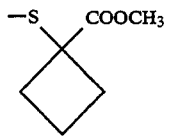 | O |
| $CF_3$ | $CH_3$ | H | $-O-CH_2-C\equiv CH$ | O |
| $CF_3$ | $CH_3$ | H | $-O-C_2H_5$ | O |

-continued

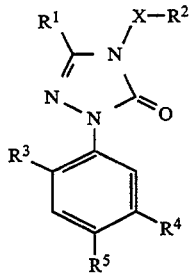

(I)

$R^5$ = CN and $NO_2$

| R1 | R2 | R3 | R4 | X |
|---|---|---|---|---|
| $CF_3$ | $CH_3$ | H | $-O-CH_3$ | O |
| $CF_3$ | $CH_3$ | H | $-S-CH_3$ | O |
| $CF_3$ | $CH_3$ | H | $-O-CH_2-CF_3$ | O |
| $CF_3$ | $CH_3$ | H | $-O-CH(CH_2F)_2$ | O |
| $CF_3$ | $CH_3$ | H | $-O-(CH_2-CH_2-O)_2-CH_3$ | O |
| $CF_3$ | $CH_3$ | H | $-O-CH_2-CH_2-O-C_2H_5$ | O |
| $CF_3$ | $CH_3$ | H | $-O-CH(CH_3)-COOC_2H_5$ | O |
| $CF_3$ | $CH_3$ | H | $-O-CH_2-COO\text{-}n\text{-}C_4H_9$ | O |
| $CF_3$ | $CH_3$ | H | $-O-CH_2-CH=CH_2$ | O |
| $CF_3$ | $CH_3$ | H | $-O-CH(CH_3)-C\equiv CH$ | O |
| $CF_3$ | $CH_3$ | H | $-S-CH_2-COOCH_3$ | O |
| $CF_3$ | $CH_3$ | H | $-S-CH_2-C\equiv CH$ | O |
| $CF_3$ | $CH_3$ | H | $-S-C_2H_5$ | O |
| $CF_3$ | $CH_3$ | H | $-O\text{-}i\text{-}C_3H_7$ | O |
| $CF_3$ | $CH_3$ | H | $-CH_2-CN$ | O |
| $CF_3$ | $CH_3$ | H | $-O-CH(CH_3)-COO-CH_2-C\equiv CH$ | O |
| $CF_3$ | $CH_3$ | H | 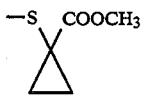 | O |
| $CF_3$ | $CH_3$ | H | 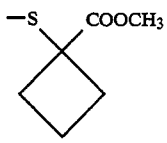 | O |
| $CF_3$ | $CH_3$ | Cl | $-O-CH_2-C\equiv CH$ | O |
| $CF_3$ | $CH_3$ | Cl | $-O-C_2H_5$ | O |
| $CF_3$ | $CH_3$ | Cl | $-O-CH_3$ | O |
| $CF_3$ | $CH_3$ | Cl | $-S-CH_3$ | O |
| $CF_3$ | $CH_3$ | Cl | $-O-CH_2-CF_3$ | O |
| $CF_3$ | $CH_3$ | Cl | $-O-CH(CH_2F)_2$ | O |
| $CF_3$ | $CH_3$ | Cl | $-O-(CH_2-CH_2-O)_2-CH_3$ | O |
| $CF_3$ | $CH_3$ | Cl | $-O-CH_2-CH_2-O-C_2H_5$ | O |
| $CF_3$ | $CH_3$ | Cl | $-O-CH(CH_3)-COOC_2H_5$ | O |
| $CF_3$ | $CH_3$ | Cl | $-O-CH_2-COO\text{-}n\text{-}C_4H_9$ | O |
| $CF_3$ | $CH_3$ | Cl | $-O-CH_2-CH=CH_2$ | O |
| $CF_3$ | $CH_3$ | Cl | $-O-CH(CH_3)-C\equiv CH$ | O |
| $CF_3$ | $CH_3$ | Cl | $-S-CH_2-COOCH_3$ | O |
| $CF_3$ | $CH_3$ | Cl | $-S-CH_2-C\equiv CH$ | O |
| $CF_3$ | $CH_3$ | Cl | $-S-C_2H_5$ | O |
| $CF_3$ | $CH_3$ | Cl | $-O\text{-}i\text{-}C_3H_7$ | O |
| $CF_3$ | $CH_3$ | Cl | $-CH_2-CN$ | O |
| $CF_3$ | $CH_3$ | Cl | $-O-CH(CH_3)-COO-CH_2-C\equiv CH$ | O |
| $CF_3$ | $CH_3$ | Cl | 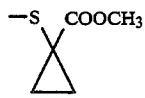 | O |
| $CF_3$ | $CH_3$ | Cl | 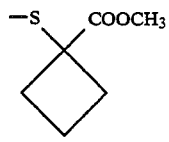 | O |
| $CF_3$ | $CH_3$ | F | $-O-CH_2-C\equiv CH$ | O |
| $CF_3$ | $CH_3$ | F | $-O-C_2H_5$ | O |
| $CF_3$ | $CH_3$ | F | $-O-CH_3$ | O |

-continued

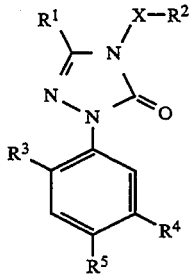

(I)

$R^5$ = CN and $NO_2$

| R1 | $R^2$ | $R^3$ | $R^4$ | X |
|---|---|---|---|---|
| $CF_3$ | $CH_3$ | F | —S—$CH_3$ | O |
| $CF_3$ | $CH_3$ | F | —O—$CH_2$—$CF_3$ | O |
| $CF_3$ | $CH_3$ | F | —O—$CH(CH_2F)_2$ | O |
| $CF_3$ | $CH_3$ | F | —O—$(CH_2—CH_2—O)_2$—$CH_3$ | O |
| $CF_3$ | $CH_3$ | F | —O—$CH_2$—$CH_2$—O—$C_2H_5$ | O |
| $CF_3$ | $CH_3$ | F | —O—$CH(CH_3)$—$COOC_2H_5$ | O |
| $CF_3$ | $CH_3$ | F | —O—$CH_2$—COO-n-$C_4H_9$ | O |
| $CF_3$ | $CH_3$ | F | —O—$CH_2$—CH=$CH_2$ | O |
| $CF_3$ | $CH_3$ | F | —O—$CH(CH_3)$—C≡CH | O |
| $CF_3$ | $CH_3$ | F | —S—$CH_2$—$COOCH_3$ | O |
| $CF_3$ | $CH_3$ | F | —S—$CH_2$—C≡CH | O |
| $CF_3$ | $CH_3$ | F | —S—$C_2H_5$ | O |
| $CF_3$ | $CH_3$ | F | —O-i-$C_3H_7$ | O |
| $CF_3$ | $CH_3$ | F | —$CH_2$—CN | O |
| $CF_3$ | $CH_3$ | F | —O—$CH(CH_3)$—COO—$CH_2$—C≡CH | O |
| $CF_3$ | $CH_3$ | F | 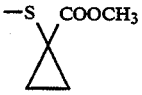 | O |
| $CF_3$ | $CH_3$ | F | 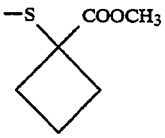 | O |
| $CH_3$ | $CHF_2$ | Cl | —O—$CH_2$—C≡CH | O |
| $CH_3$ | $CHF_2$ | Cl | —O—$C_2H_5$ | O |
| $CH_3$ | $CHF_2$ | Cl | —O—$CH_3$ | O |
| $CH_3$ | $CHF_2$ | Cl | —S—$CH_3$ | O |
| $CH_3$ | $CHF_2$ | Cl | —O—$CH_2$—$CF_3$ | O |
| $CH_3$ | $CHF_2$ | Cl | —O—$CH(CH_2F)_2$ | O |
| $CH_3$ | $CHF_2$ | Cl | —O—$(CH_2—CH_2—O)_2$—$CH_3$ | O |
| $CH_3$ | $CHF_2$ | Cl | —O—$CH_2$—$CH_2$—O—$C_2H_5$ | O |
| $CH_3$ | $CHF_2$ | Cl | —O—$CH(CH_3)$—$COOC_2H_5$ | O |
| $CH_3$ | $CHF_2$ | Cl | —O—$CH_2$—COO-n-$C_4H_9$ | O |
| $CH_3$ | $CHF_2$ | Cl | —O—$CH_2$—CH=$CH_2$ | O |
| $CH_3$ | $CHF_2$ | Cl | —O—$CH(CH_3)$—C≡CH | O |
| $CH_3$ | $CHF_2$ | Cl | —S—$CH_2$—$COOCH_3$ | O |
| $CH_3$ | $CHF_2$ | Cl | —S—$CH_2$—C≡CH | O |
| $CH_3$ | $CHF_2$ | Cl | —S—$C_2H_5$ | O |
| $CH_3$ | $CHF_2$ | Cl | —O-i-$C_3H_7$ | O |
| $CH_3$ | $CHF_2$ | Cl | —$CH_2$—CN | O |
| $CH_3$ | $CHF_2$ | Cl | —O—$CH(CH_3)$—COO—$CH_2$—C≡CH | O |
| $CH_3$ | $CHF_2$ | Cl | 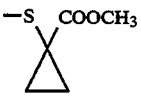 | O |
| $CH_3$ | $CHF_2$ | Cl | 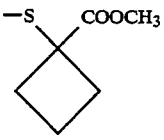 | O |
| $CH_3$ | $CHF_2$ | F | —O—$CH_2$—C≡CH | O |
| $CH_3$ | $CHF_2$ | F | —O—$C_2H_5$ | O |
| $CH_3$ | $CHF_2$ | F | —O—$CH_3$ | O |
| $CH_3$ | $CHF_2$ | F | —S—$CH_3$ | O |

-continued

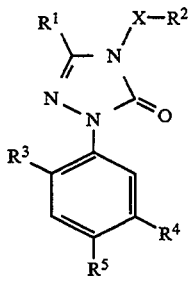

(I)

$R^5$ = CN and $NO_2$

| R1 | $R^2$ | $R^3$ | $R^4$ | X |
|---|---|---|---|---|
| $CH_3$ | $CHF_2$ | F | —O—$CH_2$—$CF_3$ | O |
| $CH_3$ | $CHF_2$ | F | —O—$CH(CH_2F)_2$ | O |
| $CH_3$ | $CHF_2$ | F | —O—$(CH_2—CH_2—O)_2$—$CH_3$ | O |
| $CH_3$ | $CHF_2$ | F | —O—$CH_2$—$CH_2$—O—$C_2H_5$ | O |
| $CH_3$ | $CHF_2$ | F | —O—$CH(CH_3)$—$COOC_2H_5$ | O |
| $CH_3$ | $CHF_2$ | F | —O—$CH_2$—COO-n-$C_4H_9$ | O |
| $CH_3$ | $CHF_2$ | F | —O—$CH_2$—CH=$CH_2$ | O |
| $CH_3$ | $CHF_2$ | F | —O—$CH(CH_3)$—C≡CH | O |
| $CH_3$ | $CHF_2$ | F | —S—$CH_2$—$COOCH_3$ | O |
| $CH_3$ | $CHF_2$ | F | —S—$CH_2$—C≡CH | O |
| $CH_3$ | $CHF_2$ | F | —S—$C_2H_5$ | O |
| $CH_3$ | $CHF_2$ | F | —O-i-$C_3H_7$ | O |
| $CH_3$ | $CHF_2$ | F | —$CH_2$—CN | O |
| $CH_3$ | $CHF_2$ | F | —O—$CH(CH_3)$—COO—$CH_2$—C≡CH | O |
| $CH_3$ | $CHF_2$ | F | 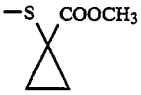 | O |
| $CH_3$ | $CHF_2$ | F | 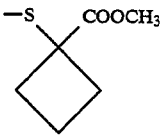 | O |
| $CF_3$ | $CHF_2$ | F | —O—$CH_2$—C≡CH | O |
| $CF_3$ | $CHF_2$ | F | —O—$C_2H_5$ | O |
| $CF_3$ | $CHF_2$ | F | —O—$CH_3$ | O |
| $CF_3$ | $CHF_2$ | F | —S—$CH_3$ | O |
| $CF_3$ | $CHF_2$ | F | —O—$CH_2$—$CF_3$ | O |
| $CF_3$ | $CHF_2$ | F | —O—$CH(CH_2F)_2$ | O |
| $CF_3$ | $CHF_2$ | F | —O—$(CH_2—CH_2—O)_2$—$CH_3$ | O |
| $CF_3$ | $CHF_2$ | F | —O—$CH_2$—$CH_2$—O—$C_2H_5$ | O |
| $CF_3$ | $CHF_2$ | F | —O—$CH(CH_3)$—$COOC_2H_5$ | O |
| $CF_3$ | $CHF_2$ | F | —O—$CH_2$—COO-n-$C_4H_9$ | O |
| $CF_3$ | $CHF_2$ | F | —O—$CH_2$—CH=$CH_2$ | O |
| $CF_3$ | $CHF_2$ | F | —O—$CH(CH_3)$—C≡CH | O |
| $CF_3$ | $CHF_2$ | F | —S—$CH_2$—$COOCH_3$ | O |
| $CF_3$ | $CHF_2$ | F | —S—$CH_2$—C≡CH | O |
| $CF_3$ | $CHF_2$ | F | —S—$C_2H_5$ | O |
| $CF_3$ | $CHF_2$ | F | —O-i-$C_3H_7$ | O |
| $CF_3$ | $CHF_2$ | F | —$CH_2$—CN | O |
| $CF_3$ | $CHF_2$ | F | —O—$CH(CH_3)$—COO—$CH_2$—C≡CH | O |
| $CF_3$ | $CHF_2$ | F | 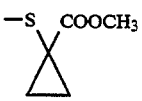 | O |
| $CF_3$ | $CHF_2$ | F | 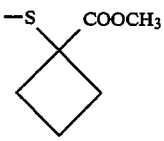 | O |
| H | $CHF_2$ | F | —O—$CH_2$—C≡CH | O |
| H | $CHF_2$ | F | —O—$C_2H_5$ | O |
| H | $CHF_2$ | F | —O—$CH_3$ | O |
| H | $CHF_2$ | F | —S—$CH_3$ | O |
| H | $CHF_2$ | F | —O—$CH_2$—$CF_3$ | O |

-continued

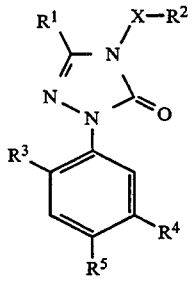

(I)

$R^5$ = CN and $NO_2$

| R1 | $R^2$ | $R^3$ | $R^4$ | X |
|---|---|---|---|---|
| H | $CHF_2$ | F | $-O-CH(CH_2F)_2$ | O |
| H | $CHF_2$ | F | $-O-(CH_2-CH_2-O)_2-CH_3$ | O |
| H | $CHF_2$ | F | $-O-CH_2-CH_2-O-C_2H_5$ | O |
| H | $CHF_2$ | F | $-O-CH(CH_3)-COOC_2H_5$ | O |
| H | $CHF_2$ | F | $-O-CH_2-COO\text{-}n\text{-}C_4H_9$ | O |
| H | $CHF_2$ | F | $-O-CH_2-CH=CH_2$ | O |
| H | $CHF_2$ | F | $-O-CH(CH_3)-C\equiv CH$ | O |
| H | $CHF_2$ | F | $-S-CH_2-COOCH_3$ | O |
| H | $CHF_2$ | F | $-S-CH_2-C\equiv CH$ | O |
| H | $CHF_2$ | F | $-S-C_2H_5$ | O |
| H | $CHF_2$ | F | $-O\text{-}i\text{-}C_3H_7$ | O |
| H | $CHF_2$ | F | $-CH_2-CN$ | O |
| H | $CHF_2$ | F | $-O-CH(CH_3)-COO-CH_2-C\equiv CH$ | O |
| H | $CHF_2$ | F | 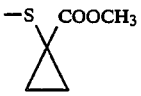 | O |
| H | $CHF_2$ | F | 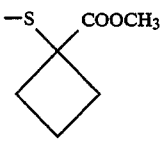 | O |
| H | $CH_3$ | F | $-O-CH_2-C\equiv CH$ | O |
| H | $CH_3$ | F | $-O-C_2H_5$ | O |
| H | $CH_3$ | F | $-O-CH_3$ | O |
| H | $CH_3$ | F | $-S-CH_3$ | O |
| H | $CH_3$ | F | $-O-CH_2-CF_3$ | O |
| H | $CH_3$ | F | $-O-CH(CH_2F)_2$ | O |
| H | $CH_3$ | F | $-O-(CH_2-CH_2-O)_2-CH_3$ | O |
| H | $CH_3$ | F | $-O-CH_2-CH_2-O-C_2H_5$ | O |
| H | $CH_3$ | F | $-O-CH(CH_3)-COOC_2H_5$ | O |
| H | $CH_3$ | F | $-O-CH_2-COO\text{-}n\text{-}C_4H_9$ | O |
| H | $CH_3$ | F | $-O-CH_2-CH=CH_2$ | O |
| H | $CH_3$ | F | $-O-CH(CH_3)-C\equiv CH$ | O |
| H | $CH_3$ | F | $-S-CH_2-COOCH_3$ | O |
| H | $CH_3$ | F | $-S-CH_2-C\equiv CH$ | O |
| H | $CH_3$ | F | $-S-C_2H_5$ | O |
| H | $CH_3$ | F | $-O\text{-}i\text{-}C_3H_7$ | O |
| H | $CH_3$ | F | $-CH_2-CN$ | O |
| H | $CH_3$ | F | $-O-CH(CH_3)-COO-CH_2-C\equiv CH$ | O |
| H | $CH_3$ | F | 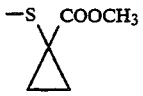 | O |
| H | $CH_3$ | F | 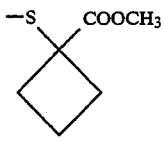 | O |
| H | $CH_3$ | Cl | $-O-CH_2-C\equiv CH$ | O |
| H | $CH_3$ | Cl | $-O-C_2H_5$ | O |
| H | $CH_3$ | Cl | $-O-CH_3$ | O |
| H | $CH_3$ | Cl | $-S-CH_3$ | O |
| H | $CH_3$ | Cl | $-O-CH_2-CF_3$ | O |
| H | $CH_3$ | Cl | $-O-CH(CH_2F)_2$ | O |

-continued

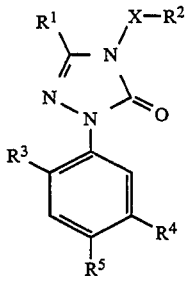

(I)

$R^5$ = CN and $NO_2$

| R1 | $R^2$ | $R^3$ | $R^4$ | X |
|---|---|---|---|---|
| H | $CH_3$ | Cl | $-O-(CH_2-CH_2-O)_2-CH_3$ | O |
| H | $CH_3$ | Cl | $-O-CH_2-CH_2-O-C_2H_5$ | O |
| H | $CH_3$ | Cl | $-O-CH(CH_3)-COOC_2H_5$ | O |
| H | $CH_3$ | Cl | $-O-CH_2-COO\text{-}n\text{-}C_4H_9$ | O |
| H | $CH_3$ | Cl | $-O-CH_2-CH=CH_2$ | O |
| H | $CH_3$ | Cl | $-O-CH(CH_3)-C\equiv CH$ | O |
| H | $CH_3$ | Cl | $-S-CH_2-COOCH_3$ | O |
| H | $CH_3$ | Cl | $-S-CH_2-C\equiv CH$ | O |
| H | $CH_3$ | Cl | $-S-C_2H_5$ | O |
| H | $CH_3$ | Cl | $-O\text{-}i\text{-}C_3H_7$ | O |
| H | $CH_3$ | Cl | $-CH_2-CN$ | O |
| H | $CH_3$ | Cl | $-O-CH(CH_3)-COO-CH_2-C\equiv CH$ | O |
| H | $CH_3$ | Cl | 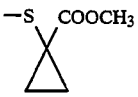 | O |
| H | $CH_3$ | Cl | 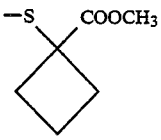 | O |

If, for example, 3-trifluoromethyl-4-methoxy-1,2,4-triazolin-5-one and 2,4,5-trifluorobenzonitrile are used as starting substances, the course of the reaction of process (a) according to the invention can be represented by the following equation:

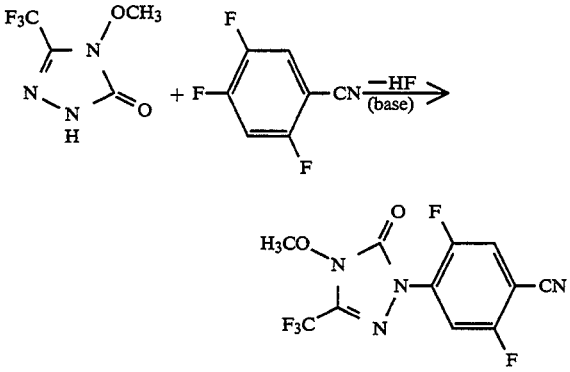

If, for example, 1-(4-cyano-2,5-difluorophenyl)-4-methoxy-3-trifluoromethyl-1,2,4-triazolin-5-one and 3-butin-2-ol are used as starting substances, the course of the reaction of process (b) according to the invention can be represented by the following equation:

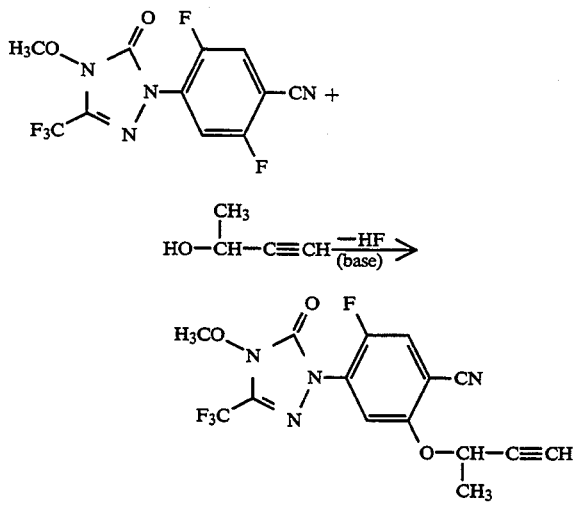

If, for example, 1-(4-cyano-2,5-difluorophenyl)-5-trifluoromethyl-(4H)-1,2,4-triazolin-5-one and dichlorofluoromethylsulphenyl chloride are used as starting substances, the course of the reaction of process (c) according to the invention can be represented by the following equation:

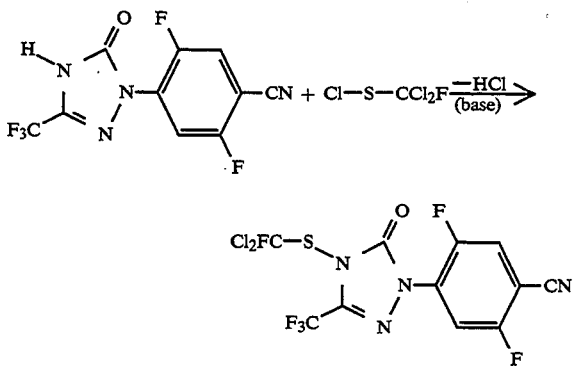

Formula (II) provides a general definition of the 1H-triazolinones required as starting substances for carrying out process (a) according to the invention. In this formula (II), $R^1$, $R^2$ and X preferably and particularly preferably represent those radicals which have already been mentioned in connection with the description of the compounds of the formula (I) according to the invention as being preferred and particularly preferred for these substituents.

The 1H-triazolinones of the formula (II) are known or can be obtained in analogy to known processes (cf., for example, EP 422,469; Arch. Pharm. 320, 1167–1173 [1987]; JP 60016978; Arch. Pharm. 301, 827–829 [1968]; DE 4,131,842).

Formula (III) provides a general definition of the halogenobenzene derivatives furthermore required as starting substances for carrying out process (a) according to the invention. In this formula (III), $R^3$, $R^4$ and $R^5$ preferably and particularly preferably represent those radicals which have already been mentioned in connection with the description of the compounds of the formula (I) according to the invention as being preferred and particularly preferred for these substituents. Hal preferably represents fluorine, chlorine or bromine, in particular fluorine or chlorine.

The halogenobenzene derivatives of the formula (III) are known or can be obtained in analogy to known processes (cf., for example, EP 191,181; EP 441,004; EP 431,373).

Formula (Ia) provides a general definition of the substituted triazolinones required as starting materials for carrying out process (b) according to the invention. In this formula (Ia), $R^1$, $R^2$, $R^3$, $R^5$ and X preferably and particularly preferably represent those radicals which have already been mentioned in connection with the description of the substances of the formula (I) according to the invention as being preferred and particularly preferred for these substituents. $R^8$ preferably represents fluorine, chlorine or bromine, in particular fluorine or chlorine.

The substituted triazolinones of the formula (Ia) are compounds according to the invention and can be obtained with the aid of processes (a) and/or (c) according to the invention.

Formula (IV) provides a general definition of the nucleophiles furthermore required as starting materials for carrying out process (b) according to the invention. In this formula (IV), Z preferably represents oxygen, sulphur or the radical —N($R^7$)—. $R^9$ preferably and particularly preferably represents those radicals which have already been mentioned in connection with the description of the substances of the formula (I) according to the invention as being preferred and particularly preferred for the substituent $R^6$, with the exception of the hydrogen radical. $R^7$ preferably and particularly preferably represents those radicals which have already been mentioned in connection with the description of the substances of the formula (I) according to the invention as being preferred and particularly preferred for this substituent. The nucleophiles of the formula (IV) are generally known compounds of organic chemistry.

Formula (V) provides a general definition of the substituted triazolinones required as educts for carrying out process (c) according to the invention. In this formula (Ib), $R^1$, $R^3$, $R^4$ and $R^5$ preferably and particularly preferably represent those radicals which have already been mentioned in connection with the description of the substances of the formula (I) according to the invention as being preferred and particularly preferred for these substituents.

The substituted triazolinones of the formula (V) are known or can be obtained in analogy to known processes (cf., for example, DE 3,839,480; U.S. Pat. No. 4,894,084; Angew. Chemie 85, 447–448 [1973]; Synth. Commun. 16, 163–167 [1986];. Liebigs Ann. Chem. 722, 29–37 [1969]; J. Indian Chem. Soc. 6, 899–901 [1930]).

Formula (VI) provides a general definition of the sulphenylating agents furthermore required as educts for carrying out process (c) according to the invention. In this formula (VI), $R^2$ preferably and particularly preferably represents those radicals which have already been mentioned in connection with the description of the substances of the formula (I) according to the invention as being preferred and particularly preferred for this substituent. Hal preferably represents fluorine, chlorine, bromine or iodine, in particular chlorine.

The suphenylating agents of the formula (V) are generally known compounds of organic chemistry.

Suitable diluents for carrying out process (a) according to the invention are inert organic solvents. These include, in particular, aliphatic, alicyclic or aromatic, optionally halogenated hydrocarbons such as, for example, benzine, benzene, toluene, xylene, chlorobenzene, dichlorobenzene, petroleum ether, hexane, cyclohexane, dichloromethane, chloroform or carbon tetrachloride; ethers, such as diethyl ether, diisopropyl ether, dioxane, tetrahydrofuran or ethylene glycol dimethyl ether or ethylene glycol diethyl ether; ketones such as acetone, butanone or methyl isobutyl ketone; nitriles such as acetonitrile, propionitrile or benzonitrile; amides such as N,N-dimethylformamide, N,N-dimethylacetamide, N-methylformanilide, N-methylpyrrolidone or hexamethylphosphoric triamide, or esters such as methyl acetate or ethyl acetate, or alcohols such as methanol, ethanol, propanol, ethylene glycol monomethyl ether or diethylene glycol monomethyl ether.

Process (a) according to the invention is preferably carried out in the presence of a suitable reaction auxiliary. Suitable reaction auxiliaries are all customary inorganic or organic bases or fluorides. These include, for example, alkaline earth metal hydroxides or alkali metal hydroxides, such as sodium hydroxide, calcium hydroxide, potassium hydroxide or else ammonium hydroxide, alkali metal carbonates such as sodium carbonate, potassium carbonate, caesium carbonate, potassium hydrogencarbonate, sodium hydrogencarbonate or ammonium carbonate, alkali metal acetates or alkaline earth metal acetates such as sodium acetate, potassium acetate, calcium acetate or ammonium acetate, sodium fluoride, potassium fluoride, and also tertiary amines such as trimethylamine, triethylamine, tributylamine, N,N-dimethylaniline, pyridine, piperidine, N-methylpiperidine, N,N-dimethylaminopyridine, diazabicyclooctane (DABCO), diazabicyclononene (DBN) or diazabicycloundecene (DBU).

When carrying out process (a) according to the invention, the reaction temperatures can be varied within a substantial range. In general, the process is carried out at temperatures between 0° C. and +180° C., preferably at temperatures between +20° C. and +120° C.

Process (a) according to the invention is conventionally carried out under atmospheric pressure. However, the process can also be carried out under elevated or reduced pressure.

To carry out process (a) according to the invention, 1.0 to 3.0 mol, preferably 1.0 to 1.5 mol, of halogenobenzene derivative of the formula (III) and, if appropriate, 1.0 to 3.0 mol, preferably 1.0 to 1.5 mol, of base as reaction auxiliary are generally employed per mole of 1H-triazolinone of the formula (II). The reaction is carried out and the reaction products are worked up and isolated by known processes (cf. in this context also the Preparation Examples).

Suitable diluents for carrying out process (b) according to the invention are inert organic solvents. The solvents mentioned in the description of process (a) according to the invention are preferably used.

Process (b) according to the invention is preferably carried out in the presence of a suitable reaction auxiliary. Suitable reaction auxiliaries are all customary inorganic or organic bases or fluorides. These include, for example, the hydrides, hydroxides, amides, alcoholates, acetates, carbonates or hydrogencarbonates of alkaline earth metals or alkali metals such as, for example, sodium hydride, sodium amide, sodium methylate, sodium ethylate, potassium tert.-butylate, sodium hydroxide, potassium hydroxide, ammonium hydroxide, sodium acetate, potassium acetate, calcium acetate, ammonium acetate, sodium carbonate, potassium carbonate, caesium carbonate, potassium hydrogencarbonate, sodium hydrogencarbonate or ammonium carbonate, sodium fluoride, potassium fluoride and tertiary amines such as trimethylamine, triethylamine, tributylamine, N,N-dimethylaniline, pyridine, N-methylpiperidine, N,N-dimethylaminopyridine, diazabicyclooctane (DABCO), diazabicyclononene (DBN) or diazabicycloundecene (DBU).

When carrying out process (b) according to the invention, the reaction temperatures can be varied within a substantial range. In general, the process is carried out at temperatures between 0° C. and +180° C., preferably at temperatures between +20° C. and +120° C.

Process (b) according to the invention is conventionally carried out under atmospheric pressure. However, the process can also be carried out under elevated or reduced pressure.

To carry out process (b) according to the invention, 1.0 to 3.0 mol, preferably 1.0 to 1.5 mol, of nucleophile of the formula (IV) and, if appropriate, 0.1 to 3.0 mol, preferably 1.0 to 1.5 mol, of base as reaction auxiliary are generally employed per mole of substituted triazolinone of the formula (Ia).

The reaction is carried out and the reaction products are worked up and isolated by known methods (cf. in this context also the Preparation Examples).

Suitable diluents for carrying out process (c) according to the invention are inert organic solvents. These include, in particular, aliphatic, alicyclic or aromatic, optionally halogenated hydrocarbons such as, for example, benzine, benzene, toluene, xylene, chlorobenzene, dichlorobenzene, petroleum ether, hexane, cyclohexane, dichloromethane, chloroform, carbon tetrachloride; ethers such as diethyl ether, diisopropyl ether, dioxane, tetrahydrofuran or ethylene glycol dimethyl ether or ethylene glycol diethyl ether; ketones such as acetone, butanone or methyl isobutyl ketone; nitriles such as acetonitrile, propionitrile or benzonitrile; amides such as N,N-dimethylformamide, N,N-dimethylacetamide, N-methylformanilide, N-methylpyrrolidone or hexamethylphosphoric triamide; esters such as methyl acetate or ethyl acetate, sulphoxides such as dimethyl sulphoxide, or acids such as acetic acid.

Process (c) according to the invention is preferably carried out in the presence of a suitable reaction auxiliary. Suitable reaction auxiliaries are all customary inorganic or organic bases. These include, for example, alkaline earth metal hydroxides or alkali metal hydroxides, such as sodium hydroxide, calcium hydroxide, potassium hydroxide, or also ammonium hydroxide, alkali metal carbonates such as sodium carbonate, potassium carbonate, caesium carbonate, potassium hydrogencarbonate, sodium hydrogencarbonate or ammonium carbonate, alkali metal acetates or alkaline earth metal acetates such as sodium acetate, potassium acetate, calcium acetate or ammonium acetate, and also tertiary amines such as trimethylamine, triethylamine, tributylamine, N,N-dimethylaniline, pyridine, piperidine, N-methylpiperidine, N,N-dimethylaminopyridine, diazabicyclooctane (DABCO), diazabicyclononene (DBN) or diazabicycloundecene (DBU).

When carrying out process (c) according to the invention, the reaction temperatures can be varied within a substantial range. In general, the process is carried out at temperatures between −20° C. and +120° C., preferably at temperatures between 0° C. and +80° C.

Process (d) according to the invention is conventionally carried out under atmospheric pressure. However, the process can also be carried out under elevated or reduced pressure.

To carry out process (d) according to the invention, 1.0 to 3.0 mol, preferably 1.0 to 2.0 mol, of sulphenylating agent of the formula (VI) and, if appropriate, 1.0 to 3.0 mol, preferably 1.0 to 2.0 mol, of base as reaction auxiliary are generally employed per mole of substituted triazolinone of the formula (V).

The reaction is carried out and the reaction products are worked up and isolated by known methods (cf. in this context also the Preparation Examples).

The end products of the formula (I) are purified with the aid of customary methods, for example by column chromatography or by recrystallisation.

They are characterised with the aid of the melting point or, in the case of compounds which do not crystallise, with the aid of proton nuclear resonance spectroscopy ($^1$H NMR).

The active compounds according to the invention can be used as defoliants, desiccants, agents for destroying broad-leaved plants and, especially, as weed-killers. By weeds, in the broadest sense, there are to be understood all plants which grow in locations where they are undesired. Whether the substances according to the invention act as total or selective herbicides depends essentially on the amount used.

The active compounds according to the invention can be used, for example, in connection with the following plants:

Dicotyledon weeds of the genera: Sinapis, Lepidium, Galium, Stellaria, Matricaria, Anthemis, Galinsoga, Chenopodium, Urtica, Senecio, Amaranthus, Portulaca, Xanthium, Convolvulus, Ipomoea, Polygonum, Sesbania, Ambrosia, Cirsium, Carduus, Sonchus, Solanum, Rorippa, Rotala, Lindernia, Lamium, Veronica, Abutilon, Emex, Datura, Viola, Galeopsis, Papaver, Centaurea, Trifolium, Ranunculus and Taraxacum.

Dicotyledon cultures of the genera: Gossypium, Glycine, Beta, Daucus, Phaseolus, Pisum, Solanum, Linum, Ipomoea, Vicia, Nicotiana, Lycopersicon, Arachis, Brassica, Lactuca, Cucumis and Cucurbita.

Monocotyledon weeds of the genera: Echinochloa, Setaria, Panicum, Digitaria, Phleum, Poa, Festuca, Eleusine, Brachiaria, Lolium, Bromus, Avena, Cyperus, Sorghum, Agropyron, Cynodon, Monochoria, Fimbristylis, Sagittaria, Eleocharis, Scirpus, Paspalum, Ischaemum, Sphenoclea, Dactyloctenium, Agrostis, Alopecurus and Apera.

Monocotyledon cultures of the qenera: Oryza, Zea, Triticum, Hordeum, Avena, Secale, Sorghum, Panicum, Saccharum, Ananas, Asparagus and Allium.

However, the use of the active compounds according to the invention is in no way restricted to these genera, but also extends in the same manner to other plants.

The compounds are suitable, depending on the concentration, for the total combating of weeds, for example on industrial terrain and rail tracks, and on paths and squares with or without tree plantings. Equally, the compounds can be employed for combating weeds in perennial cultures, for example afforestations, decorative tree plantings, orchards, vineyards, citrus groves, nut orchards, banana plantations, coffee plantations, tea plantations, rubber plantations, oil palm plantations, cocoa plantations, soft fruit plantings and hopfields, and for the selective combating of weeds in annual cultures.

In this context, the active compounds according to the invention can be employed particularly successfully for selectively combating monocotyledon and dicotyledon weeds in dicotyledon cultures such as, for example, soya beans or cotton.

In addition, the active compounds according to the invention also have fungicidal properties and can be employed, at suitable application rates, for example also for combating cereal diseases, such as, for example, against the pathogen causing powdery mildew of cereals (*Erysiphe graminis*) or for combating rice diseases such as, for example, against the pathogen causing rice blast disease (*Pyricularia oryzae*).

The active compounds can be converted into the customary formulations, such as solutions, emulsions, suspensions, powders, foams, pastes, granules, aerosols, natural and synthetic materials impregnated with active compound, and very fine capsules in polymeric substances.

These formulations are produced in a known manner, for example by mixing the active compounds with extenders, that is liquid solvents, liquefied gases under pressure and/or solid carriers, optionally with the use of surface-active agents, that is emulsifying agents and/or dispersing agents and/or foam-forming agents.

In the case of the use of water as an extender, organic solvents can, for example, also be used as auxiliary solvents. As liquid solvents, there are suitable in the main: aromatics, such as xylene, toluene or alkylnaphthalenes, chlorinated aromatics or chlorinated aliphatic hydrocarbons, such as chlorobenzenes, chloroethylenes or methylene chloride, aliphatic hydrocarbons, such as cyclohexane or paraffins, for example petroleum fractions, mineral and vegetable oils, alcohols, such as butanol or glycol as well as their ethers and esters, ketones, such as acetone, methyl ethyl ketone, methyl isobutyl ketone or cyclohexanone, strongly polar solvents, such as dimethylformamide and dimethyl sulphoxide, as well as water.

As solid carriers there are suitable: for example ammonium salts and ground natural minerals, such as kaolins, clays, talc, chalk, quartz, attapulgite, montmorillonite or diatomaceous earth, and ground synthetic minerals, such as highly disperse silica, alumina and silicates; as solid carriers for granules there are suitable: for example crushed and fractionated natural rocks such as calcite, marble, pumice, sepiolite and dolomite, as well as synthetic granules of inorganic and organic meals, and granules of organic material such as sawdust, coconut shells, maize cobs and tobacco stalks; as emulsifying and/or foam-forming agents there are suitable: for example non-ionic and anionic emulsifiers, such as polyoxyethylene fatty acid esters, polyoxyethylene fatty alcohol ethers, for example alkylaryl polyglycol ethers, alkylsulphonates, alkyl sulphates, arylsulphonates as well as albumen hydrolysis products; as dispersing agents there are suitable: for example lignin-sulphite waste liquors and methylcelluloseAdhesives Adhesives such as carboxymethylcellulose and natural and synthetic polymers in the form of powders, granules or latexes, such as gum arabic, polyvinyl alcohol and polyvinyl acetate, as well as natural phospholipids, such as cephalins and lecithins, and synthetic phospholipids, can be used in the formulations. Further additives can be mineral and vegetable oils.

It is possible to use colorants such as inorganic pigments, for example iron oxide, titanium oxide and Prussian Blue, and organic dyestuffs, such as alizarin dyestuffs, azo dyestuffs and metal phthalocyanine dyestuffs, and trace nutrients such as salts of iron, manganese, boron, copper, cobalt, molybdenum and zinc.

The formulations in general contain between 0.1 and 95 per cent by weight of active compound, preferably between 0.5 and 90%.

For combating weeds, the active compounds according to the invention, as such or in the form of their formulations, can also be used as mixtures with known herbicides, finished formulations or tank mixes being possible.

Suitable herbicides for the mixtures are known herbicides, for example anilides such as, for example, diflufenican and propanil; arylcarboxylic acids such as, for example, dichloropicolinic acid, dicamba or picloram; aryloxyalkanoic acids such as, for example, 2,4-D, 2,4-DB, 2,4-DP, fluroxypyr, MCPA, MCPP and triclopyr; aryloxy-phenoxy-alkanoic esters such as, for example, diclofop-methyl, fenoxaprop-ethyl, fluazifop-butyl, haloxyfop-methyl and quizalofop-ethyl; azinones such as, for example, chloridazon and norflurazon; carbamates such as, for example, chlorpropham, desmedipham, phenmedipham and propham; chloroacetanilides such as, for example, alachlor, acetochlor, butachlor, metazachlor, metolachlor, pretilachlor and propachlor; dinitroanilines such as, for example, oryzalin, pendimethalin and trifluralin; diphenyl ethers such as, for example, acifluorfen, bifenox, fluoroglycofen, fomesafen, halosafen, lactofen and oxyfluorfen; ureas such as, for example, chlortoluron, diuron, fluometuron, isoproturon, linuron and methabenzthiazuron; hydroxylamines such as, for example, alloxydim, clethodim, cycloxydim, sethoxydim and tralkoxydim; imidazolinones such as, for example, imazethapyr, imazamethabenz, imazapyr and imazaquin; nitriles such as, for example, bromoxynil, dichlobenil and ioxynil; oxyacetamides such as, for example, mefenacet; sulphonylureas such as, for example, amidosulfuron, bensulfuron-methyl, chlorimuron-ethyl, chlorsulfuron, cinosulfuron, metsulfuron-methyl, nicosulfuron, primisulfuron, pyrazosulfuron-ethyl, thifensulfuronmethyl, triasulfuron and tribenuron-methyl; thiocarbamates such as, for example, butylate, cycloate, diallate, EPTC, esprocarb, molinate, prosulfocarb, thiobencarb and tri-allate; triazines such as, for example, atrazine, cyanazine, simazine, simetryn, terbutryn and terbutylazine; triazinones such as, for example, hexazinone, metamitron and metribuzin; others such as, for example, aminotriazole, benfuresate, bentazone, cinmethylin, clomazone, clopyralid, difenzoquat, dithiopyr, ethofumesate, fluorochloridone, glufosinate, glyphosate, isoxaben, pyridate, quinchlorac, quinmerac, sulphosate and tridiphane.

Mixtures with other known active compounds, such as fungicides, insecticides, acaricides, nematicides, bird repellants, plant nutrients and agents which improve soil structure, are also possible.

The active compounds can be used as such, in the form of their formulations or in the use forms prepared therefrom by further dilution, such as ready-to-use solutions, suspensions, emulsions, powders, pastes and granules. They are used in the customary manner, for example by watering, spraying, atomising or scattering.

The active compounds according to the invention can be applied either before or after emergence of the plants. They can also be incorporated into the soil before sowing.

The amount of active compound used can vary within a substantial range. It depends essentially on the nature of the desired effect. In general, the amounts used are between 0.01 and 10 kg of active compound per hectare of soil surface, preferably between 0.05 and 5 kg per hectare.

The preparation and use of the active compounds according to the invention can be seen from the following Examples.

PREPARATION EXAMPLES

EXAMPLE 1

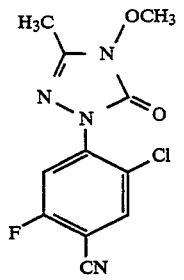

Process a 7.0 g (0.04 mol ) of 5-chloro-2,4-difluorobenzonitrile are added at room temperature to 5.2 9 (0.04 mol) of 4-methoxy-3-methyl-1H-1,2,4-triazolin-5-one (cf., for example, EP 422,469) and 5.5 g (0.04 mol) of potassium carbonate in 50 ml of dimethyl sulphoxide, and the mixture is subsequently stirred for 16 hours at room temperature. For work-up, the reaction mixture is concentrated in vacuo, the residue is taken up in dichloromethane, and the mixture is subsequently washed in succession with dilute hydrochloric acid and water, dried over magnesium sulphate and freed from solvent in vacuo.

8.5 g (75% of theory) of 1-(2-chloro-4-cyano-5-fluorophenyl)-4-methoxy-3-methyl-1,2,4-triazolin-5-one of melting point 102° C. are obtained.

PREPARATION OF THE STARTING COMPOUND

EXAMPLE III-1

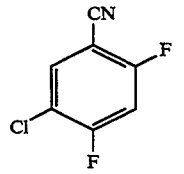

220 g (1.06 mol) of 2,4,5-trichlorobenzonitrile (cf., for example, EP 441,004) are added with stirring at room temperature to 250 g (4.31 mol) of potassium fluoride in 400 ml of distilled tetramethylene sulphone, and the mixture is subsequently stirred for 10 hours at 195° C. to 200° C. For work-up, the mixture is cooled, 500 ml of water are added, and the mixture is subjected to steam distillation. The organic portion is taken up in dichloromethane, dried over sodium sulphate, concentrated in vacuo and distilled.

108 g (58% of theory) of 2,4-difluoro-5-chlorobenzonitrile having a boiling point of 105°–107° C. at 30 mbar and a melting point of 48°–50° C. are obtained.

EXAMPLE 2

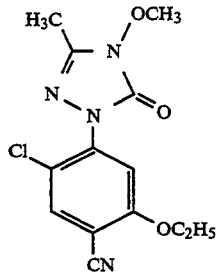

Process b 2.8 g (0.01 mol) of 1-(2-chloro-4-cyano-5-fluorophenyl)-4-methoxy-3-methyl-1,2,4-triazolin-5-one, dissolved in 10 ml of dry ethanol, are added with stirring at room temperature to a solution of 0.012 mol of sodium ethylate in 10 ml of ethanol, and the mixture is subsequently stirred for 16 hours at room temperature. For work-up, the -reaction mixture is concentrated in vacuo, the residue is taken up in 30 ml of dichloromethane, and the mixture is washed in succession with dilute hydrochloric acid and water, dried over sodium sulphate and freed from solvent in vacuo. The residue can be purified by chromatography on silica gel (eluent: dichloromethane/methanol 40:1).

0.8 g (25% of theory) of 1-(2-chloro-4-cyano-5-ethoxyphenyl)-4-methoxy-3-methyl-l,2,4-triazolin-5-one of melting point 115° C. is obtained.

EXAMPLE 3

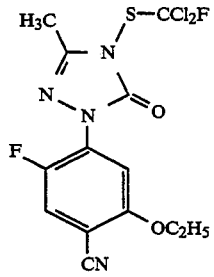

Process c 4.2 g (0.025 mol) of dichlorofluoromethylsulphenyl chloride and 2.5 g (0.025 mol) of triethylamine are added in succession with stirring at 0° C. to 5° C. to a solution of 2.6 g (0.01 mol) of 1-(2-fluoro-4-cyano-5-ethoxyphenyl)-3-methyl-4H-1,2,4-triazolin-5-one in 80 ml of carbon tetrachloride, and the mixture is subsequently reflexed for 12 hours. For work-up, the reaction mixture is washed with water, dried over sodium sulphate and concentrated in vacuo. The residue can be purified by chromatography on silica gel (eluent: dichloromethane/methanol 100:1).

1.3 g (33% of theory) of 1-(2-fluoro-4-cyano-5-ethoxyphenyl)-3-methyl-4-dichlorofluoromethylsulphenyl-1,2,4-triazolin-5-one of melting point 185° C. are obtained.

PREPARATION OF THE STARTING COMPOUND

EXAMPLE V-1

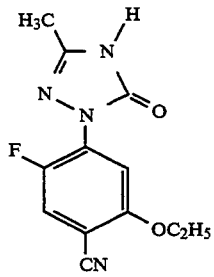

5.4 g (0.023 mol) of 1-(2,5-difluoro-4-cyanophenyl)-3-methyl-4H-1,2,4-triazolin-5-one (cf. for example, DE 3,839,480), dissolved in 40 ml of dry ethanol, are added at room temperature with stirring to a solution of 0.07 mol of sodium ethylate in 40 ml of ethanol, such an amount of ethanol is then distilled off that the internal temperature of the reaction mixture reaches 130° C., and the mixture is subsequently stirred at this temperature for a further 7 hours. For work-up, the reaction mixture is concentrated in vacuo, the residue is taken up in dichloromethane, and the mixture is washed in succession with dilute hydrochloric acid and water, dried over sodium sulphate and freed from solvent in vacuo.

5.3 g (88% of theory) of 1-(2-fluoro-4-cyano-5-ethoxyphenyl)-3-methyl-4H-1,2,4-triazolin-5-one of melting point 204° C. are obtained.

The following substituted triazolinones of the general formula (I)

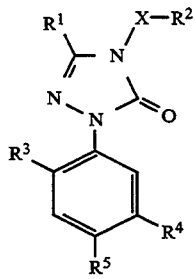

(I)

are obtained in a corresponding manner and following the general information on the preparation:

| Ex. No. | 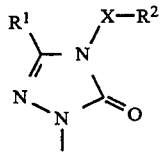 | $R^3$ | $R^4$ | $R^5$ | Physical Properties |
|---|---|---|---|---|---|
| 4 | 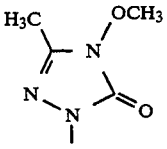 | F | —S-n-$C_4H_9$ | CN | m.p. 115° C. |
| 5 | 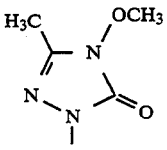 | F | H | CN | m.p. 156° C. |
| 6 | 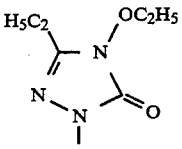 | F | H | CN | m.p. 78° C. |
| 7 | 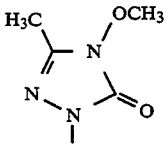 | F | —S—$CH_2$—$COOC_2H_5$ | CN | m.p. 65° C. |
| 8 | 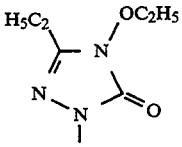 | H | F | CN | m.p. 114° C. |
| 9 | 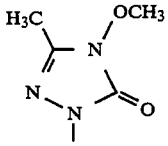 | H | F | CN | m.p. 185° C. |
| 10 | 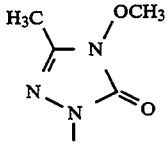 | F | 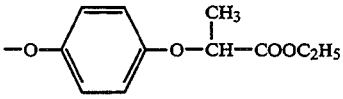 | CN | $^1$H NMR*): 7.48(d, 1H) |
| 11 | 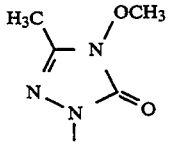 | F | —O—$CH_2$—$C_6H_5$ | CN | m.p. 143° C. |

-continued
| Ex. No. | 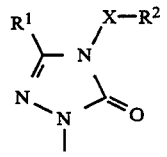 | $R^3$ | $R^4$ | $R^5$ | Physical Properties |
|---|---|---|---|---|---|
| 12 | 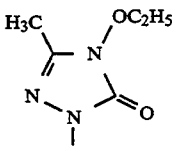 | F | F | CN | m.p. 89° C. |
| 13 | 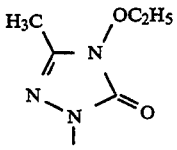 | F | H | CN | m.p. 138° C. |
| 14 | 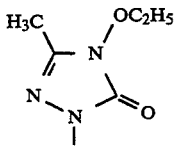 | F | $-O-CH_3$ | CN | m.p. 97° C. |
| 15 | 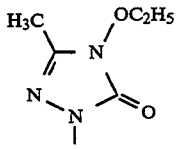 | F | $-O-C_2H_5$ | CN | m.p. 80° C. |
| 16 | 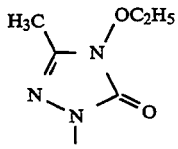 | F | $-O-CH(CH_3)-C\equiv CH$ | CN | |
| 17 | 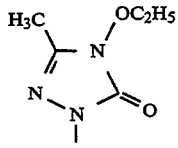 | F | 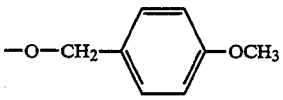 | CN | $^1H$ NMR*): 5.12(s, 2H) |
| 18 | 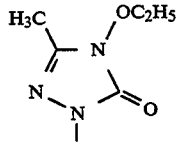 | F | $-(O-CH_2-CH_2)_2-OCH_3$ | CN | m.p. 50° C. |
| 19 | 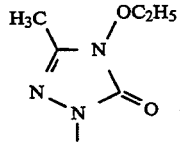 | F | $-S-C_2H_5$ | CN | m.p. 78° C. |

-continued
| Ex. No. | 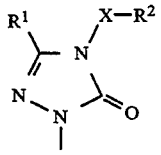 | $R^3$ | $R^4$ | $R^5$ | Physical Properties |
|---|---|---|---|---|---|
| 20 | 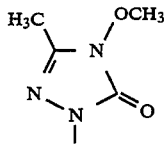 | F | $-O-CH_2-CH_2-OCH_3$ | CN | m.p. 114° C. |
| 21 | 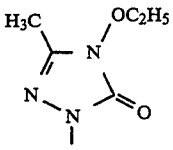 | F | $-S-CH_3$ | CN | |
| 22 | 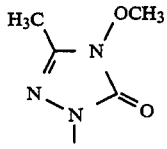 | F | $-S-CH_3$ | CN | |
| 23 | 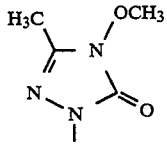 | H | CN | CN | m.p. 174–175° C. |
| 24 | 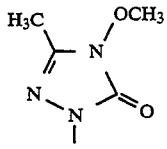 | F | Cl | CN | m.p. 167° C. |
| 25 | 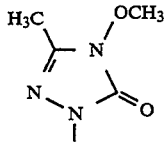 | F | F | CN | m.p. 107° C. |
| 26 | 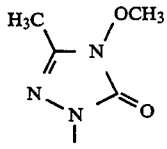 | F | $-O-CH_3$ | CN | m.p. 160° C. |
| 27 | 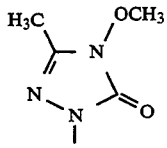 | F | $-O-CH(CH_3)-C\equiv CH$ | CN | m.p. 118° C. |

-continued
| Ex. No. | 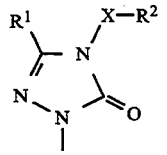 | $R^3$ | $R^4$ | $R^5$ | Physical Properties |
|---|---|---|---|---|---|
| 28 | 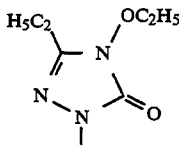 | F | F | CN | m.p. 40° C. |
| 29 | 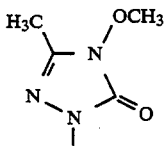 | F | $-O-C_2H_5$ | CN | m.p. 114° C. |
| 30 | 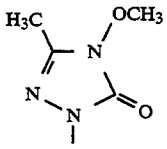 | F | $-S-C_2H_5$ | CN | m.p. 104° C. |
| 31 | 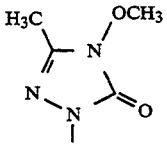 | Cl | $-O\text{-}n\text{-}C_3H_7$ | CN | m.p. 132° C. |
| 32 | 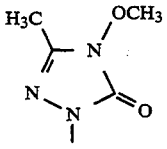 | Cl | $-(O-CH_2-CH_2)_2-OCH_3$ | CN | m.p. 61° C. |
| 33 | 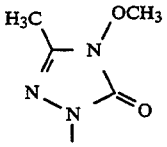 | Cl | $-S\text{-}n\text{-}C_4H_9$ | CN | m.p. 104° C. |
| 34 | 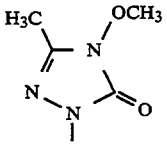 | Cl | $-S-C_2H_5$ | CN | m.p. 106° C. |
| 35 | 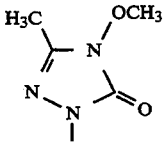 | Cl | $-O-CH(CH_3)-C\equiv CH$ | CN | $^1H$ NMR*): 2.59(d, 1H) |

-continued
| Ex. No. | 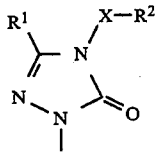 | $R^3$ | $R^4$ | $R^5$ | Physical Properties |
|---|---|---|---|---|---|
| 36 | 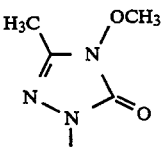 | Cl | $-S-CH_2-COOC_2H_5$ | CN | |
| 37 | 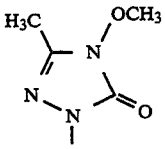 | Cl | 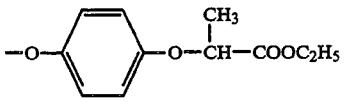 | CN | $^1$H NMR*): 4.72(q, 1H) |
| 38 | 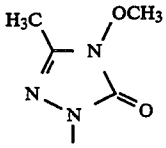 | H | $-O-CH(CH_3)-C\equiv CH$ | CN | |
| 39 | 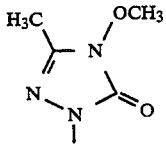 | H | $-(O-CH_2-CH_2)_2-OCH_3$ | CN | |
| 40 | 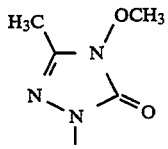 | Cl | $-S-CH_3$ | CN | m.p. 175° C. |
| 41 | 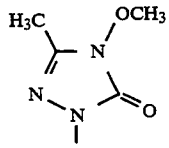 | F | $-O\text{-}i\text{-}C_4H_9$ | CN | |
| 42 | 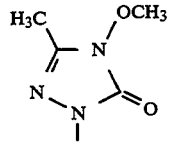 | F | $-(O-CH_2-CH_2)_2-OCH_3$ | CN | m.p. 68° C. |
| 43 | 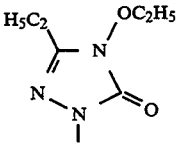 | F | $-O-CH_3$ | CN | m.p. 66° C. |

-continued
| Ex. No. | 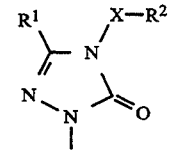 | $R^3$ | $R^4$ | $R^5$ | Physical Properties |
|---|---|---|---|---|---|
| 44 | 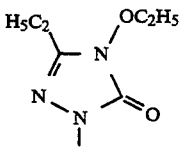 | F | $-O-C_2H_5$ | CN | $^1$H NMR*): 7.41(d, 1H) |
| 45 | 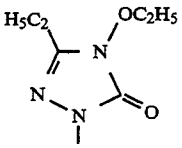 | F | $-O\text{-}i\text{-}C_3H_7$ | CN | m.p. 105° C. |
| 46 | 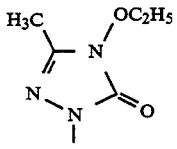 | Cl | $-S-C_2H_5$ | CN | m.p. 116–118° C. |
| 47 | 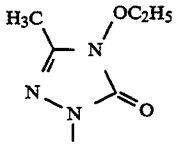 | Cl | $-O-CH(CH_3)-C\equiv CH$ | CN | m.p. 125–126° C. |
| 48 | 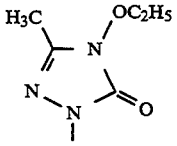 | Cl | $-O-CH_2-Si(CH_3)_3$ | CN | m.p. 103–105° C. |
| 49 | 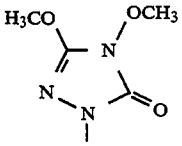 | F | F | CN | m.p. 132° C. |
| 50 | 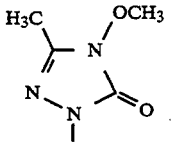 | F | F | $NO_2$ | m.p. 150–151° C. |
| 51 | 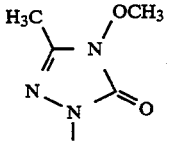 | F | $-O-CH(CH_3)-C\equiv CH$ | $NO_2$ | m.p. 118–120° C. |

-continued
| Ex. No. | 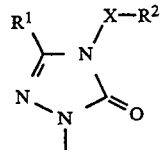 | $R^3$ | $R^4$ | $R^5$ | Physical Properties |
|---|---|---|---|---|---|
| 52 | 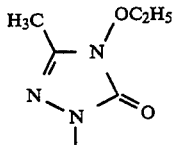 | Cl | Cl | $NO_2$ | m.p. 158–160° C. |
| 53 | 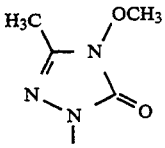 | Cl | H | $NO_2$ | m.p. 185–186° C. |
| 54 | 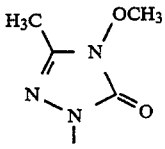 | Cl | F | CN | m.p. 126–128° C. |
| 55 | 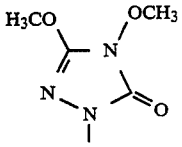 | F | 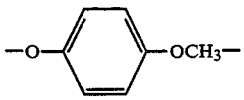 | CN | Fp. 180 C. |
| 56 | 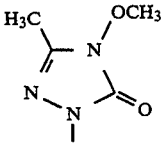 | F | 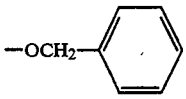 | $NO_2$ | Fp. 112 C. |
| 57 | 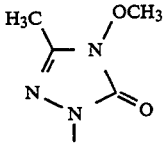 | F | 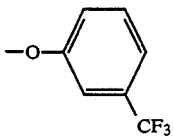 | $NO_2$ | Fp. 112 C. |
| 58 | 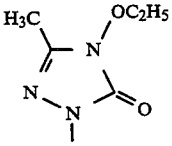 | Cl | —SH | $NO_2$ | Fp. 187 C. |
| 59 | 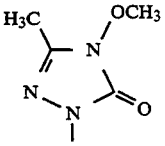 | Cl | 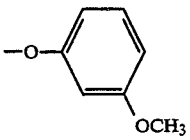 | $NO_2$ | Fp. 127 C. |

-continued

| Ex. No. | 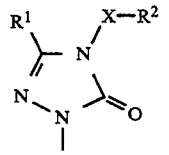 | $R^3$ | $R^4$ | $R^5$ | Physical Properties |
|---|---|---|---|---|---|
| 60 | 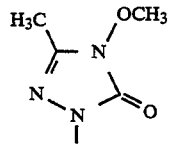 | Cl | 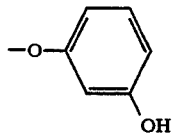 | CN | |
| 61 | 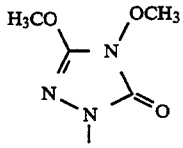 | F | 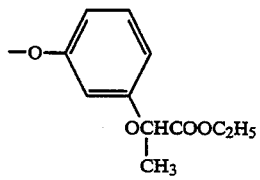 | CN | |

*)The $^1H$ NMR spectra were recorded in deuterochloroform ($CDCl_3$) with tetramethylsilane (TMS) as the internal standard. The chemical shift is given as the δ value in ppm.

Use Examples

In the Use Example which follows, the compound given below was used as comparison substance:

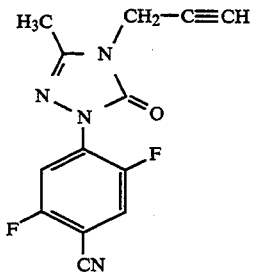

(A)

3-Methyl-4-propargyl-1-(2,5-difluoro-4-cyanophenyl)-1,2,4-triazolin-5-one (disclosed in DE 3,839,480)

EXAMPLE A

Pre-emergence test

Solvent: 5 parts by weight of acetone

Emulsifier: 1 part by weight of alkylaryl polyglycol ether

To produce a suitable preparation of active compound, one part by weight of active compound is mixed with the stated amount of solvent, the stated amount of emulsifier is added and the concentrate is diluted with water to the desired concentration.

Seeds of the test plants are sown in normal soil and, after 24 hours, watered with the preparation of the active compound. It is expedient to keep constant the amount of water per unit area. The concentration of the active compound in the preparation is of no importance, only the amount of active compound applied per unit area being decisive. After three weeks, the degree of damage to the plants is rated in % damage in comparison to the development of the untreated control.

The figures denote:

0%=no action (like untreated control)

100%=total destruction

In this test, a clearly superior activity compared with the prior art is shown, for example, by the compounds of Preparation Examples 24, 25, 26, 27, 29 and 42.

It will be understood that the specification and examples are illustrative but not limitative of the present invention and that other embodiments within the spirit and scope of the invention will suggest themselves to those skilled in the art.

What is claimed is:

1. A substituted triazolinone of the formula

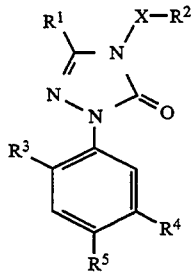

(I)

wherein $R^2$ represents hydrogen, alkyl, alkoxy, halogenoalkyl or halogenoalkoxy, $R^2$ represents hydrogen, alkyl or halogenoalkyl, $R^3$ represents hydrogen or halogen, $R^4$ represents hydrogen, cyano, halogen or a radical of the formula —O—$R^6$, —S—$R^6$, —C(O)—O—$R^6$, —C(O)—S —$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or in each case optionally substituted alkyl, alkenyl, alkinyl, cycloalkyl, cycloalkylalkyl, cycloalkoxycarbonyl, aryl or arylalkyl.

2. A substituted triazolinone of according to claim 1, wherein $R^1$ represents hydrogen or in each case straight—chain or branched alkyl, alkoxy, halogenoalkyl or halogenoalkoxy, each of which has 1 to 8 carbon atoms and, when present, 1 to 17 identical or different halogen atoms, $R^2$ represents hydrogen or in each cast straight-chain or branched alkyl or halogenoalkyl, each of which has 1 to 8 carbon atoms and, when present, 1 to 17 identical or different halogen atoms, $R^3$ represents hydrogen, fluorine, chlorine, bromine or iodine, $R^4$represents hydrogen, cyano, fluorine, chlorine, bromine, iodine or a radical of the formula —O—$R^6$, —S—$R^6$, —C(O)—O—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or straight-chain or branched alkyl which has 1 to 8 carbon atoms and which is optionally monosubstituted or polysubstituted by identical or different substituents wherein the substituents are halogen, cyano, carboxyl, carbamoyl, in each case straight-chain or branched alkoxy, alkoxyalkoxy, halogenoalkoxy where in said halogen is fluorine, chlorine, bromine and iodine, alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkylsulphonylaminocarbonyl, each of which has up to 8 carbon atoms in the individual alkyl or alkenyl or alkinyl moieties, or heterocyclyl, the heterocyclyl radical being represented by a five- to seven-membered, optionally benzo-fused, saturated or unsaturated heterocycle having 1 to 3 identical or different hetero atoms, wherein said heteroatoms are nitrogen, oxygen and sulphur;

$R^6$ and $R^7$ furthermore represent alkenyl or alkinyl, each of which has 2 to 8 carbon atoms and each of which is optionally monosubstituted or polysubstituted by identical or different substituents from the group consisting of fluorine, chlorine, bromine and iodine;

$R^6$ and $R^7$ furthermore represent cycloalkyl, cycloalkylalkyl or cycloalkyloxycarbonyl, each of which has 3 to 8 carbon atoms in the cycloalkyl moiety and 1 to 4 carbon atoms in the straight-chain or branched alkyl moiety, and each of which is optionally monosubstituted or polysubstituted in the cycloalkyl moiety by identical or different substituents from the group consisting of fluorine, chlorine, bromine iodine, $C_1$-$C_4$ straight-chain or branched alkyl and $C_1$-$C_4$ straight-chain or branched alkoxycarbonyl, or $R^6$and $R^7$ represent arylalkyl or aryl, each of which has 6 to 10 carbon atoms in the aryl moiety and 1 to 4 carbon atoms in the straight-chain or branched alkyl moiety and each of which is optionally monosubstituted or polysubstituted in the aryl moiety by identical or different substituents, when said substituents are halogen, cyano, nitro, in each case straight-chain or branched alkyl, alkoxy, alkylthio, alkylsulphinyl or alkylsulphonyl, each of which has 1 to 6 carbon atoms, in each case straight-chain or branched halogenoalkyl, halogenoalkoxy, halogenoalkylthio, halogenoalkylsulphinyl or halogenoalkylsulphonyl, each of which has 1 to 6 carbon atoms and 1 to 13 identical or different halogen atoms, straight-chain or branched alkoxycarbonylalkyloxy having 1 to 6 carbon atoms in the individual alkyl moieties, and phenyl which is optionally monosubstituted or polysubstituted by identical or different substituents selected from the group consisting of halogen, $C_1$-$C_4$ straight chain or branched alkyl, $C_1$-$C_4$ straight chain or branched alkoxy, $C_1$-$C_4$ straight chain or branched halogenoalkyl, and $C_1$-$C_4$ straight chain or branched halogenoalkoxy, wherein said halogenoalkyl or halogenoalkoxy moieties have 1 to 13 identical or different halogen atoms, and said halogen atoms are fluorine, chlorine, bromine and iodine.

3. A substituted triazolinone according to claim 1, wherein $R^1$ represents hydrogen or in each case straight-chain or branched alkyl, alkoxy, halogenalkyl or halogenoalkoxy, each of which has 1 to 6 carbon atoms and, when present, 1 to 13 identical or different halogen atom, $R^2$represents hydrogen or in each case straight-chain or branched alkyl or halogenoalkyl, each of which has 1 to 6 carbon atoms and, if appropriate, 1 to 13 identical or different halogen atoms, wherein said halogen atoms are fluorine, chlorine or bromine, $R^3$ represents hydrogen, fluorine, chlorine or bromine, $R^4$represents hydrogen, cyano, fluorine, chlorine, bromine or a radical of the formula —O—$R^6$, —S—$R^6$, —C(O)—O—$R^6$, —C(O)—S—$R^6$, —$NR^6R^7$, or —C(O)—$NR^6R^7$, $R^5$ represents cyano or nitro and X represents oxygen or sulphur, where $R^6$ and $R^7$ independently of one another in each case represent hydrogen or straight—chain or branched alkyl which has 1 to 6 carbon atoms and which is optionally monosubstituted to disubstituted by identical or different substituents, wherein said substituents are selected from the group consisting of cyano, carboxyl, carbamoyl, in each case straight-chain or branched alkoxy, alkoxyalkoxy, halogenoalkoxy wherein said halogen is fluorine, chlorine and bromine, alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkylsulphonylaminocarbonyl, each of which has up to 6 carbon atoms in the individual alkyl or alkenyl or alkinyl moieties, or heterocyclyl, where the heterocyclyl radical is represented by a 5- or 6-membered, saturated or unsaturated heterocycle which has 1 to 3 identical or different hetero atoms wherein said heteroatoms are nitrogen, oxygen and sulphur;

$R^6$ and $R^7$ furthermore represent straight-chain or branched halogenoalkyl having 1 to 6 carbon atoms and 1 to 13 identical or different halogen atoms, said halogen atoms are fluorine, chlorine and bromine;

$R^6$ and $R^7$ furthermore represent alkenyl or alkinyl, each of which has 2 to 6 carbon atoms and each of which is optionally monosubstituted to pentasubstituted by identical or different substituents from the group consisting of fluorine, chlorine and bromine;

$R^6$ and $R^7$ furthermore represent cycloalkyl, cycloalkylalkyl or cycloalkyloxycarbonyl, each of which has 3 to 7 carbon atoms in the cycloalkyl moiety and 1 to 3 carbon atoms in the straight-chain or branched alkyl moiety, and each of which is optionally monosubstituted to tetrasubstituted in the cycloalkyl moiety by identical or different substituents from the group consisting of fluorine, chlorine, bromine, $C_1$-$C_3$ straight chain or branched alkyl, $C_1$-$C_3$ straight chain or branched alkoxy and alkoxycarbonyl, or $R^6$ and $R^7$ represent arylalkyl or aryl, each of which has 6 or 10 carbon atoms in the aryl moiety and 1 to 3 carbon atoms in the straight-chain or branched alkyl moiety, and each of which is optionally monosubstituted to pentasubstituted in the aryl moiety by identical or different substituents, wherein said substituents are halogen, cyano, nitro, hydroxy, in each case straight-chain or branched alkyl, alkoxy, alkylthio, alkylsulphinyl or alkylsuphonyl, each of which has 1 to 4 carbon atoms, in each case straight-chain or branched halogenoalkyl, halogenoalkoxy, halogenoalkylthio, halogenoalkylsulphinyl or halogenoalkylsulphonyl, each of which has 1 to 4 carbon atoms and 1 to 9 identical or different halogen atoms, straight-chain or branched alkoxycarbonylalkyloxy having 1 to 4 carbon atoms in the individual alkyl moieties, and phenyl which is optionally monosubstituted to pentasubstituted by identical or different substituents from the group consisting of halogen, $C_1$-$C_4$ straight-chain or branched alkyl, $C_1$-$C_4$ straight-chain or branched alkoxy, $C_1$-$C_4$ straight-chain or branched halogenoalkyl and $C_1$-$C_4$ halogenoalkoxy, wherein said halogeno and halogenoalkoxy moieties have 1 to 9 identical or different halogen atoms, and the halogen atoms are fluorine, chlorine and bromine.

4. A substituted triazolinone of the according to claim 1, wherein $R^1$ represents hydrogen or in each case straight-chin or branched alkyl, alkoxy, halogenoalkyl or halogenoalkoxy, each of which has 1 to 4 carbon atoms and, when present, 1 to 9 identical or different halogen atoms, $R^2$ represents hydrogen or in each case straight-chain or branched alkyl or halogenoalkyl, each of which has 1 to 4 carbon atoms and, when present 1 to 9 identical or different halogen atoms, $R^3$ represents hydrogen, fluorine, chlorine or bromine, $R^4$ represents hydrogen, cyano, fluorine, chlorine, bromine or a radical of the formula —O—$R^6$, —S—$R^6$, —C(O)—O—$R^6$, —C(O)—S—$R^6$, —$NR^6R^7$ or —C(O)—$NR^6R^7$, $R^5$ represents cyano or nitro and X represents oxygen or sulphur, where $R^6$ and $R^7$ independently of one another in each case represent hydrogen or straight-chain or branched alkyl which has 1 to 4 carbon atoms and which is optionally monosubstituted, wherein said substituents are cyano, carboxyl, carbamoyl, in each case straight-chain or branched alkoxy, alkoxyalkoxy, halogenoalkoxy, where said halogen is fluorine, chlorine and bromine, alkylthio, alkylsulphinyl, alkylsulphonyl, alkylcarbonyl, alkoxycarbonyl, alkenyloxycarbonyl, alkinyloxycarbonyl, alkoxyalkoxycarbonyl, N-alkylaminocarbonyl, N,N-dialkylaminocarbonyl, trialkylsilyl or alkylsulphonylaminocarbonyl, each of which has up to 4 carbon atoms in the individual alkyl or alkenyl or alkinyl moieties, or heterocyclyl, where the heterocyclyl radical is a 5- or 6-membered, saturated or unsaturated heterocycle which has 1 to 3 identical or different hetero atoms, wherein said hetero atoms are nitrogen, oxygen and sulphur;

$R^6$ and $R^7$ furthermore represent straight-chain or branched halogenoalkyl having 1 to 4 carbon atoms and 1 to 9 identical or different halogen atoms, wherein said atoms are fluorine, chlorine and bromine;

$R^6$ and $R^7$ furthermore represent alkenyl or alkinyl, each of which has 3 to 5 carbon atoms and each of which is optionally monosubstituted to trisubstituted by identical or different halogen substituents, wherein said substituents are fluorine, chlorine and bromine;

$R^6$ and $R^7$ furthermore represent cycloalkyl, cycloalkylalkyl or cycloalkoxycarbonyl, each of which has 3 to 6 carbon atoms in the cycloalkyl moiety and 1 to 2 carbon atoms in the alkyl moiety, and each of which is optionally monosubstituted or disubstituted in the cycloalkyl moiety by identical or different substituents from the group consisting of fluorine, chlorine, bromine, methyl, ethyl, methoxy, ethoxy, methoxycarbonyl and ethoxycarbonyl, or $R^6$and $R^7$ represent phenylalkyl or phenyl, each of which is optionally monosubstituted to trisubstituted in the phenyl moiety by identical or different substituents and has 1 or 2 carbon atoms in the alkyl moiety, and suitable phenyl substituents are halogen, cyano, nitro, hydroxy, in each case straight-chain or branched alkyl, alkoxy, alkylthio, alkylsulphinyl or alkylsulphonyl, each of which has 1 to 3 carbon atoms, or in each case straight-chain or branched halogenoalkyl, halogenoalkoxy, halogenoalkylthio, halogenoalkylsulphinyl or halogenoalkylsulphonyl, each of which has 1 to 3 carbon atoms and 1 to 7 identical or different halogen atoms, and straight-chain or branched alkoxycarbonylalkyloxy having 1 to 2 carbon atoms in the individual alkyl moieties, and said halogen atoms are fluorine, chlorine and bromine.

5. A substituted triazolinone of the formula (I) according to claim 1 wherein such compound is 1-(2-fluoro-4-cyano-5-chloro-phenyl)-4-methoxy-3-methyl-1,2,4-triazolin-5-one of the formula

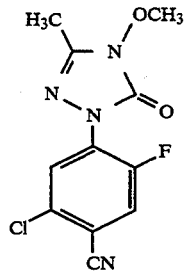

6. A substituted triazolinone of the formula (I) according to claim 1 wherein such compound is 1-(2,5-difluoro-4-cyano-phenyl)-4-methoxy-3-methyl-1,2,4-triazolin-5-one of the formula

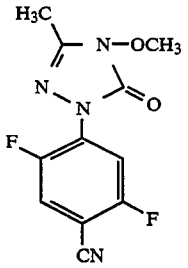

7. A substituted triazolinone of the formula (I) according to claim 1 wherein such compound is 1-(2-fluoro-4-cyano-5-methoxy-phenyl)-4-methoxy-3-methyl-1,2,4-triazolin-5-one of the formula

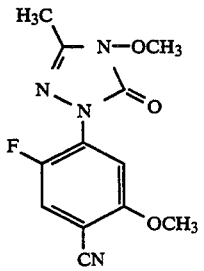

8. A substituted triazolinone of the formula (I) according to claim 1 wherein such compound is 1-(2-fluoro-4-cyano-5-(3-methyl)-prop-1-in-phenyl)-4-methoxy-3-methyl-1,2,4-triazolin-5-one of the formula

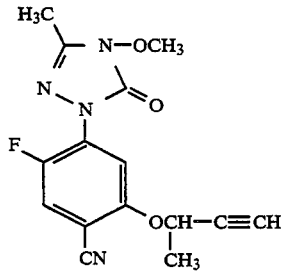

9. A substituted triazolinone of the formula (I) according to claim 1 wherein such compound is 1-(2-fluoro-4-cyano-5-ethoxy-phenyl)-4-methoxy-3-methyl-1,2,4-triazolin-5-one of the formula

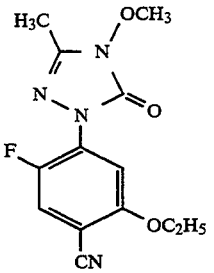

10. A substituted triazolinone of the formula (I) according to claim 1 wherein such compound is 1-(2-fluoro-4-cyano-5-methoxyethoxyethoxyphenyl)-4-methoxy-3-methyl-1,2,4-triazolin-5-one of the formula

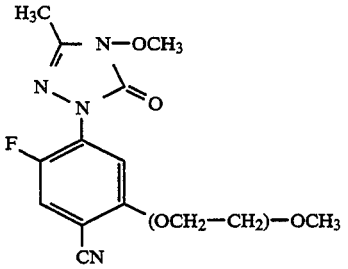

11. A herbicidal composition comprising a herbicidally effective amount of a compound according to claim 1 and a diluent.

12. A method of combating unwanted vegetation which comprises applying to such vegetation or to a locus from which it is desired to exclude such vegetation a herbicidally effective amount of a compound according to claim 1.

13. The method according to claim 12, wherein such compound is 1-(2-fluoro-4-cyano-5-chloro-phenyl)-4-methoxy-3-methyl-1,2,4-triazolin-5-one 1-(2,5-difluoro-4-cyano-phenyl)-4-methoxy-3-methyl-1,2,4-triazolin-5-one 1-(2-fluoro-4-cyano-5-methoxy-phenyl)-4-methoxy-3-methyl-1,2,4-triazolin-5-one 1-(2-fluoro-4-cyano-5-(3-methyl)-prop-1-in-phenyl)-4-methoxy-3-methyl-1,2,4-triazolin-5-one 1-(2-fluoro-4-cyano-5-ethoxy-phenyl)-4-methoxy-5-methyl-1,2,4-triazolin-5-one 1-(2-fluoro-4-cyano-5-methoxyethoxyethoxy-phenyl)-4-methoxy-3-methyl-1,2,4-triazolin-5-one

* * * * *